US008584574B2

(12) United States Patent
Wössner et al.

(10) Patent No.: US 8,584,574 B2
(45) Date of Patent: Nov. 19, 2013

(54) WEAPONS, WEAPONS HOUSINGS AND METHODS OF PRODUCING SUCH WEAPONS AND WEAPONS HOUSINGS

(75) Inventors: Ernst Wössner, Oberndorf (DE); Stefan Doll, Oberndorf (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 0 days.

(21) Appl. No.: 13/356,242

(22) Filed: Jan. 23, 2012

(65) Prior Publication Data

US 2012/0180646 A1 Jul. 19, 2012

Related U.S. Application Data

(63) Continuation of application No. PCT/EP2011/000717, filed on Feb. 15, 2011.

(30) Foreign Application Priority Data

Feb. 26, 2010 (DE) ..... 10 2010 009 488

(51) Int. Cl.
*F41A 3/66* (2006.01)

(52) U.S. Cl.
USPC ..... 89/191.01; 89/9; 89/125; 42/75.1; 42/96

(58) Field of Classification Search
USPC ..... 89/9, 191.01, 125; 42/75.1, 96
See application file for complete search history.

(56) References Cited

U.S. PATENT DOCUMENTS 1,907,164 A * 5/1933 White ..... 89/138
2,308,627 A * 1/1943 Rickenbacher ..... 42/71.02
3,030,723 A * 4/1962 Ivy ..... 42/65
3,342,171 A * 9/1967 Ryan et al. ..... 124/55
3,830,003 A * 8/1974 Clerke ..... 42/75.03
4,315,379 A * 2/1982 Lang ..... 42/71.02

(Continued)

FOREIGN PATENT DOCUMENTS

DE 102007011504 9/2008
EP 1357348 10/2003

(Continued)

OTHER PUBLICATIONS

International Searching Authority "Written Opinion," issued in connection with International Application No. PCT/EP2011/000717, mailed on May 30, 2011, 16 pages.

(Continued)

*Primary Examiner* — Daniel J Troy
*Assistant Examiner* — Benjamin Gomberg
(74) *Attorney, Agent, or Firm* — Hanley, Flight and Zimmerman, LLC

(57) ABSTRACT

Weapons, weapon housing and methods of producing such weapons and weapon housings are disclosed. An example weapon housing for use with a firearm includes at least two housing shells. Each of the housing shells comprises at least one positioning recess. The example weapon housing also includes at least one connection block comprising connecting pins. On an assembly plane of the connection block, the housing shells are to be positioned and aligned on the connecting pins via the respective positioning recess to enable forces that are to act in or against a direction of fire to be absorbed by surfaces of at least one of the positioning recesses or one or more of the connecting pins.

28 Claims, 8 Drawing Sheets

(56) References Cited

U.S. PATENT DOCUMENTS

| | | | | | |
|---|---|---|---|---|---|
| 4,463,654 | A | * | 8/1984 | Barnes et al. | 89/128 |
| 4,553,469 | A | * | 11/1985 | Atchisson | 89/191.02 |
| 4,596,084 | A | * | 6/1986 | Martial | 42/75.03 |
| 4,663,876 | A | * | 5/1987 | Reaume | 42/71.01 |
| 4,872,391 | A | * | 10/1989 | Stoner | 89/155 |
| 4,930,399 | A | * | 6/1990 | Trevor, Jr. | 89/191.02 |
| 5,440,099 | A | | 8/1995 | Smith | |
| 5,580,474 | A | | 12/1996 | Smith | |
| 2003/0196366 | A1 | * | 10/2003 | Beretta | 42/71.01 |
| 2009/0031607 | A1 | * | 2/2009 | Robinson et al. | 42/16 |
| 2011/0023694 | A1 | * | 2/2011 | Haywood | 89/9 |
| 2011/0168009 | A1 | * | 7/2011 | Robb et al. | 89/194 |

FOREIGN PATENT DOCUMENTS

| | | |
|---|---|---|
| GB | 572924 | 10/1945 |
| WO | 9703785 | 2/1997 |
| WO | 2008106697 | 9/2008 |
| WO | 2008147491 | 12/2008 |

OTHER PUBLICATIONS

International Searching Authority "Search Report," issued in connection with International Application No. PCT/EP2011/000717, mailed on May 30, 2011, 4 pages.

* cited by examiner

WEAPONS, WEAPONS HOUSINGS AND METHODS OF PRODUCING SUCH WEAPONS AND WEAPONS HOUSINGS

RELATED APPLICATION

This patent is a continuation of International Patent Application Serial No.: PCT/EP2011/000717, filed Feb. 15, 2011, which claims priority to German Patent Application 10 2010 009 488.9, filed on Feb. 26, 2010, both of which are hereby incorporated herein by reference in their entireties.

FIELD OF THE DISCLOSURE

This patent relates generally to weapons and, more specifically, to weapons, weapon housing and methods of producing such weapons and weapon housings.

BACKGROUND

Some known weapon and/or firearm housings (e.g., machine guns housings) such as, the housings of the MG42/MG3, M60, NF1/AA52, FN MINIMI, PKS Kalashnikov, HK MG4, etc., are made of sheet metal stamped parts. When assembling the FN MINIMI machine gun, individual housing parts are extensively welded, which may cause distortion of the mold and/or housing parts. U.S. Pat. Nos. 5,440,099; 5,580,474; and International Patent Application No. WO 97/03785 A1 describe elaborate welding methods that attempt to minimize distortion to the mold and/or the housing when welding the individual housing parts.

Because the individual housing parts are often thin-walled stamped sheet metal parts, the parts are difficult to align and may require elaborate welding and/or stabilization. As such, the profitability of manufacturing such weapon housings may be decreased as well as the dimensional tolerances, dimensional stability, production tolerances, etc.

Other known weapon and/or firearm housings such as, housings of the MG34, the light Bren MG and the light Browning BAR MG, are made of milled parts and have a single-piece weapon housing. Housings of weapons from the 1920's and 1930's partially support and guide the breach block and, thus, require high manufacturing precision to ensure secure and/or proper functionality of the breach block.

Other known weapon and/or firearm housings such as, the housings of the N MAG from the 1950s and the Browning .50 MG from 1917, are made of riveted, prefabricated housing components. Guide rails on the MG 4, or other attachment parts may be riveted to weapon housings. While riveting is an alternative to welding, riveting is expensive and has poor tolerances.

International Patent Application No. WO 2008/147491 describes a machine gun having a housing with two perpendicular split housing halves. The housing halves, which are welded together, each include a holding fixture (e.g., ribs) for a gas rod, barrel, breech guide, reinforcement structures, etc.

DE 10 2007 011 504 A1 describes a two-part breach housing and a centering device for a breech block. The breech housing is inserted from the rear of the firearm into the weapons housing and is centered using guiding grooves. The breech housing is detachably fixed via locking means.

EP 1 357 348 B1 describes a weapon housing having two polymer housing half stocks. The half stocks are coupled together using weld(s), connection elements, grooves, a spring and/or connecting edges. For reinforcement and/or connection purposes, a polymer insert and/or strand is inserted into a recess.

WO 2008/106697 A1 describes a rifle body with a base support where two side panels or plates are detachably coupled via a snap fastener or snap lock connection. The side panels and/or attachment elements can be made of plastic. Alternatively, the side panels can be riveted to the support.

DETAILED DESCRIPTION

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity. Additionally, several examples have been described throughout this specification. Any features from any example may be included with, a replacement for, or otherwise combined with other features from other examples. Further, throughout this description, position designations such as "above," "below," "top," "forward," "rear," "left," "right," etc. are referenced to a firearm held in a normal firing position (i.e., wherein the "shooting direction" is pointed away from the marksman in a generally horizontal direction) and from the point of view of the marksman. Furthermore, the normal firing position of the weapon is always assumed, i.e., the position in which the barrel runs along a horizontal axis.

Known weapon housings, including the weapon housings described above, are elaborate and expensive to produce and/or assemble. Additionally, known weapon housings, including the weapon housings described above, may cause production tolerances and/or imprecision that may impair the functionality of auxiliary equipment (e.g., sighting devices, etc.).

The examples disclosed herein relate to weapon housings and methods of producing such weapon housings that are less elaborate, more cost-effective, etc. as compared to some known weapon housings. The examples disclosed herein relate to example weapon housings, example weapons and/or firearms including the example weapon housings and/or methods of assembling example weapon housings.

Figure 1:
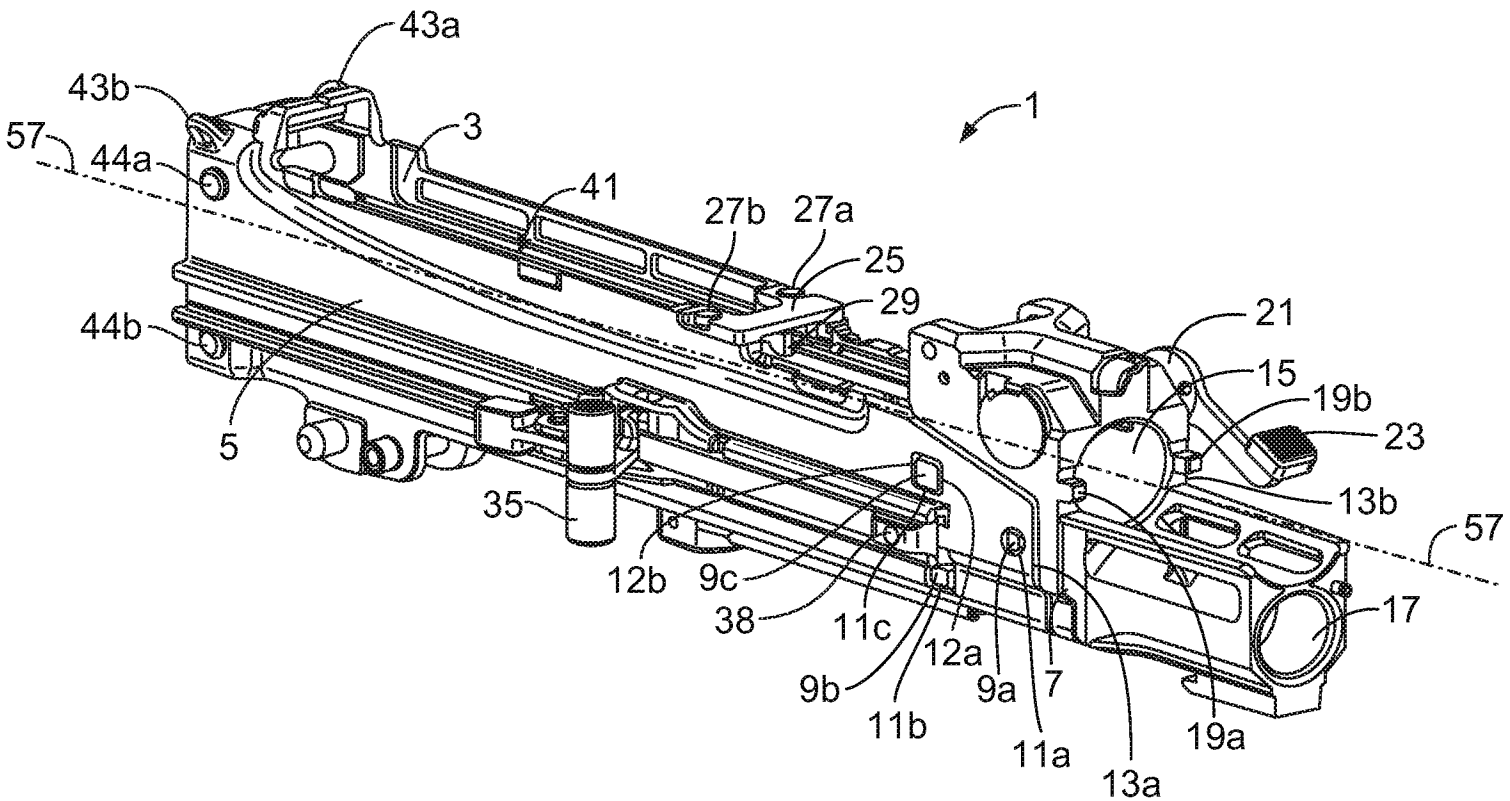
FIG. 1 depicts a perspective view of an example assembled weapon housing in accordance with the teachings of this disclosure.
Figure 2:
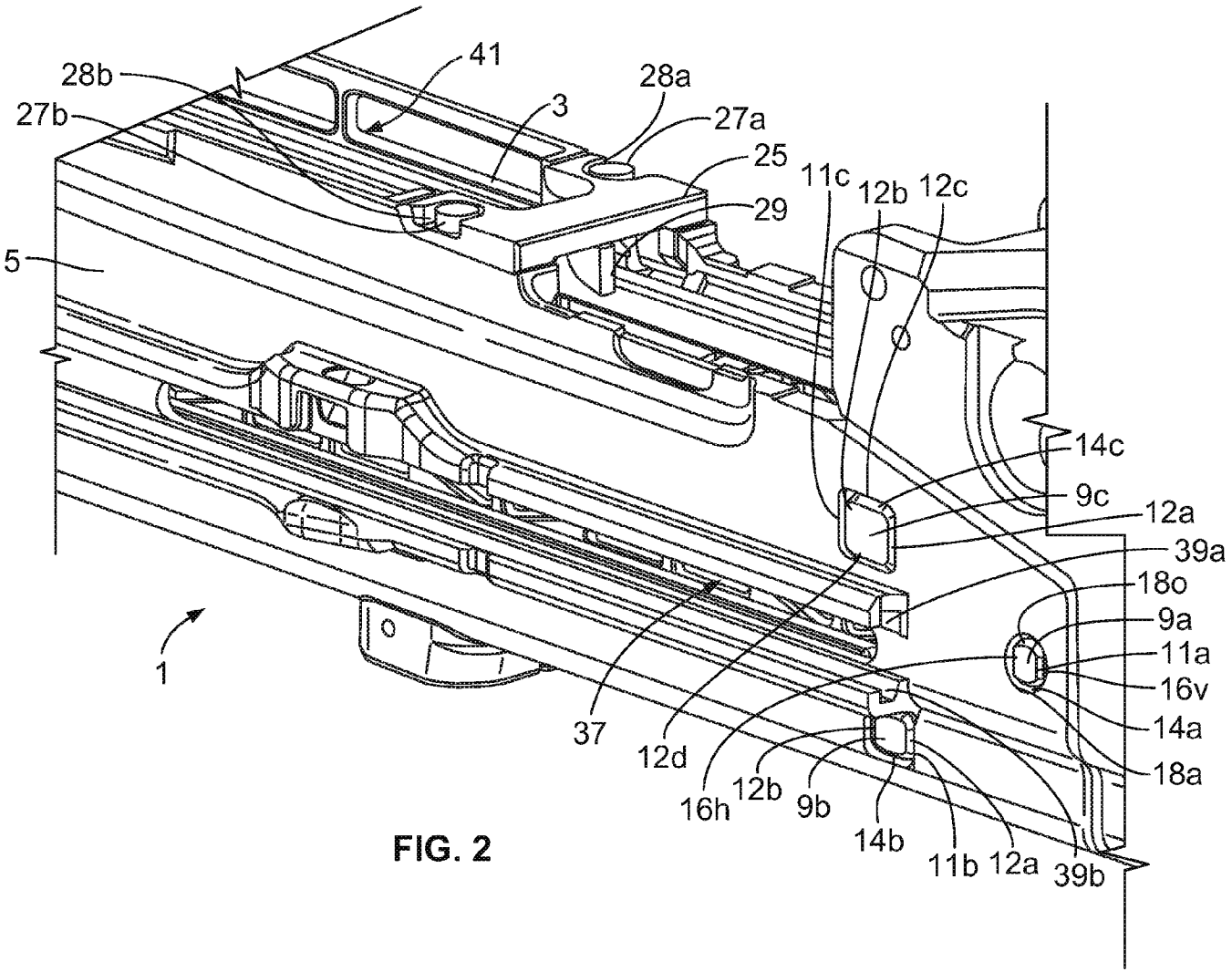
FIG. 2 depicts an enlarged view of the example weapon housing of FIG. 1.
Figure 3:
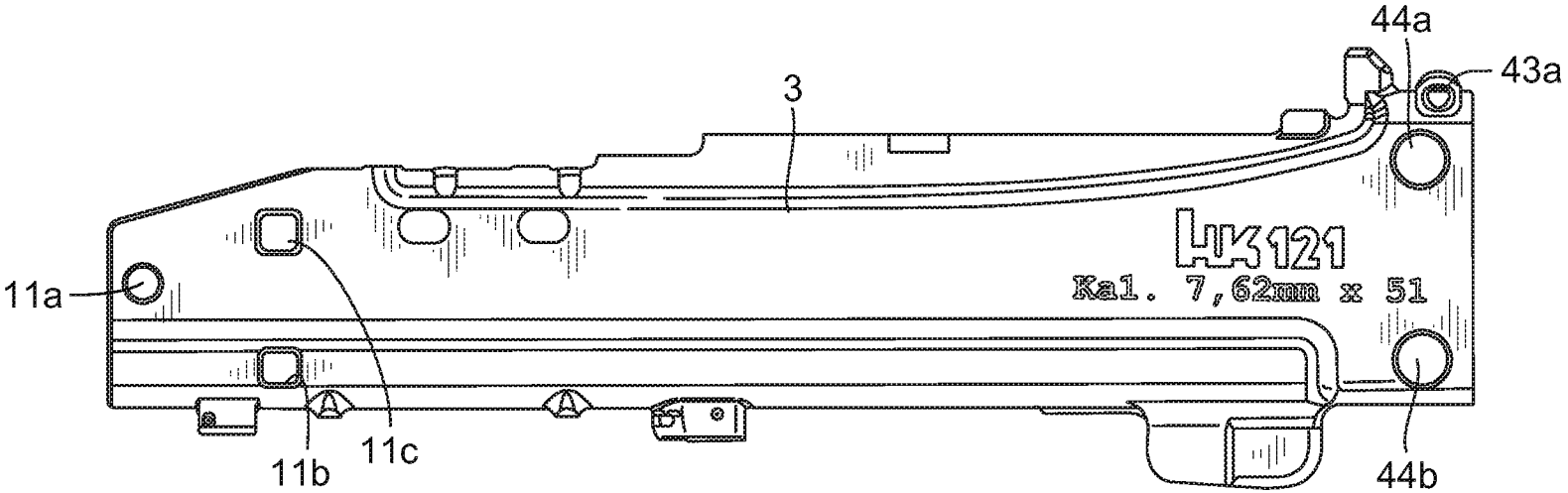
FIG. 3 depicts a lateral view of the left exterior of an example first housing shell in accordance with the teachings of this disclosure.
Figure 4:
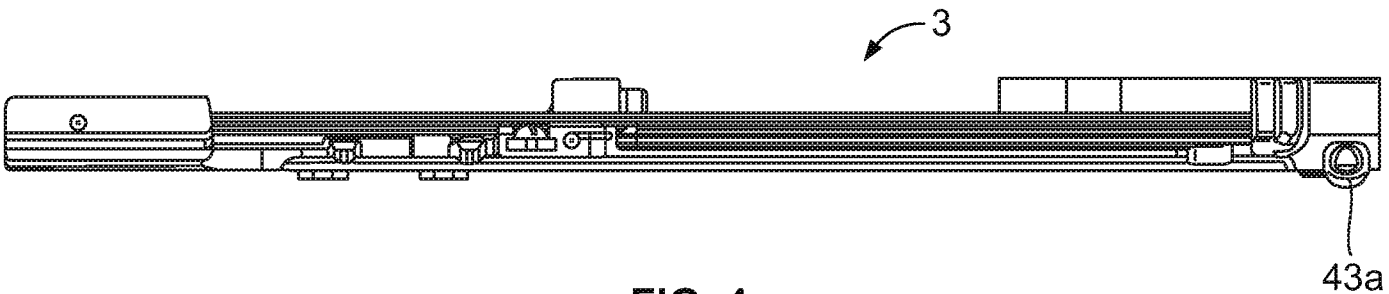
FIG. 4 depicts a top view of the example first housing shell of FIG. 3.

FIG. 1 depicts an example assembled weapon or weapon housing 1. FIG. 2 depicts an enlarged view of the example weapon housing 1 of FIG. 1. FIGS. 3-8 depict various views of example housing shells 3, 5. FIGS. 9-12 depict various views of the example housing shells 3, 5 coupled and/or assembled together.

Referring to FIG. 1, the example weapon housing 1 includes the first and second housing shells 3, 5 and an example connection block 7. The housing shells 3, 5 may be finished (e.g., put into their final configuration) during production. Additionally or alternatively, the housing shells 3, 5 may be subsequently milled, bored, processed, etc., from the inside and/or outside after, for example, the housing shells 3, 5 are coupled together. In some examples, the housing shells 3, 5 have internal profiles.

In this example, the example connection block 7 includes lateral coupling flanks 13*a*, 13*b* each including three connecting pins, protrusions and/or elements 9*a*, 9*b* and 9*c*. The housing shells 3, 5 each include positioning recesses, openings and/or apertures 11*a*, 11*b* and 11*c* that are configured to engage and/or receive the connecting pins 9*a*, 9*b* and 9*c* when the housing shells 3, 5 are placed on and/or coupled to the connection block 7. While three connecting pins 9*a*, 9*b* and 9*c* and three positioning recesses 11*a*, 11*b* and 11*c* are disclosed, any other number of connecting pins (1, 2, 4, etc.) and/or recesses (1, 2, 4, etc.) may be included instead. The coupling flanks 13*a*, 13*b* of the connection block 7 are reference surfaces, lateral planes, assembly planes, etc., that enable the housing shells 3, 5 to be coupled and/or aligned relative to the connection block 7. Surface regions and/or inner surfaces 10*a*, 10*b* and/or 10*c* (See FIGS. 5, 8, 13, 14) that define the positioning recesses 11*a*, 11*b* and 11*c* may be positioned adjacent to, in contact with, flush against, etc., the corresponding coupling flanks 13*a*, 13*b*. In some examples, the connection block 7 forms the front of the weapon housing 1 and is aligned with and/or aligns relative to the longitudinal axis of the weapon housing 1.

In this example, the positioning recess 11*a* is circular and the connecting pins 9*a* have a flattened portion 16*v*, 16*h* such that the connecting pins 9*a* have a flattened circular cross-section. The flattened portion 16*v*, 16*h* may be vertically positioned toward the front and rear of the weapon housing 1 at an angle (e.g., perpendicular) relative to an axis of a bore 57 (See FIG. 2). In this example, the connecting pins 9*b*, 9*c* and/or the positioning recesses 11*b*, 11*c* are angular, rectangular and/or square with rounded corner regions. The receipt by and/or engagement between the connecting pins 9*a*, 9*b* and 9*c* and the positioning recesses 11*a*, 11*b* and 11*c* positively couple the connection block 7 and the housing shells 3, 5.

In this example, the receipt by and/or engagement between the connecting pin 9*a* and the positioning recess 11*a* provide a form closure that runs to and/or between upper and lower coupling regions or surfaces 18*o*, *u* (See FIG. 2). The connecting pin 9*a* fixes the housing shells 3, 5 in the vertical direction. The front and rear vertical transverse surfaces or coupling regions 12*a* and 12*b* of the connecting pins 9*b* and 9*c* secures, forms a closure, etc., relative to the positioning recesses 11*b* and 11*c* at an angle relative to the axis of the bore 57 (e.g., or the direction of fire).

In this example, between upper and lower surfaces 12*c* and 12*d* of the connecting pins 9*b* and 9*c* running lengthwise relative to the axis of the bore 57 and the opposing surfaces of the positioning recesses 11*b* and 11*c*, there is increased clearance to prevent fitting problems adjacent to the upper and lower coupling regions (e.g., 18*o*, 18*u*). In this example, the edges of the connecting pins 9*a*, 9*b* and 9*c* and the edges and/or surfaces of the positioning recesses 11*a*, 11*b* and 11*c* are beveled and form V-shaped, revolving connecting joints 14*a*, 14*b* and 14*c*.

When assembling the housing shells 3, 5 and the connection block 7, the housing shells 3, 5 are brought into an assembled and/or aligned position via the connecting pins 9*a*, 9*b* and 9*c* of the coupling flanks 13*a* and 13*b*. In the process of assembling the housing shells 3, 5 on the connection block 7, the connecting pins 9*a*, 9*b* and 9*c* are gravitationally centered in, for example, the respective positioning recesses 11*a*, 11*b* and 11*c*. For the form closure, the positioning recesses 11*a*, 11*b* and 11*c* are placed with relatively tight clearance adjacent to the coupling regions 18*o*, 18*u*, 12*a* and 12*b* on the connecting pins 9*a*, 9*b* and 9*c*.

In some examples, the housing shells 3, 5 are coupled together (e.g., welded, connected, etc.) adjacent to and/or in the region of the connecting pins 9*a*, 9*b* and 9*c* and/or adjacent to and/or in the region of the connecting joints 14*a*, 14*b* and 14*c* (See FIGS. 2, 13) formed therebetween. If the housing shells 3, 5 are welded together, the housing shells 3, 5 may be welded using any suitable welding method such as, for example, Wolfram-Inert-Gas (WIG) welding, metal inert gas (MIG)/metal active gas (MAG) welding and/or laser welding.

When a weapon is fired that includes the weapon housing 1, the weapon and/or components thereof are subjected to high mechanical loads and/or forces. At least some of these mechanical loads and/or forces may be absorbed by the connecting pins 9*a*, 9*b* and/or 9*c*. For example, loads and/or forces that act in the longitudinal direction are transferred mainly between the front and rear coupling regions 12*a* and 12*b* of the connecting pins 9*b* and 9*c* and the positioning recesses 11*b* and 11*c*. To securely transfer the loads and/or forces acting in the longitudinal direction, the overall cross-section of the connecting pins 9*b* and 9*c* is greater than the overall cross-section of the connecting pin 9*a*. The loads and/or forces acting in the longitudinal direction may be greater than the loads and/or forces acting in the vertical direction at an angle relative to the axis of the bore 57. As such, the active coupling surfaces (e.g., surfaces running vertically) may be greater size and/or dimensions than the rounded coupling regions 18*o* and 18*u* of the connecting pin 9*a*, for example.

Figure 10:
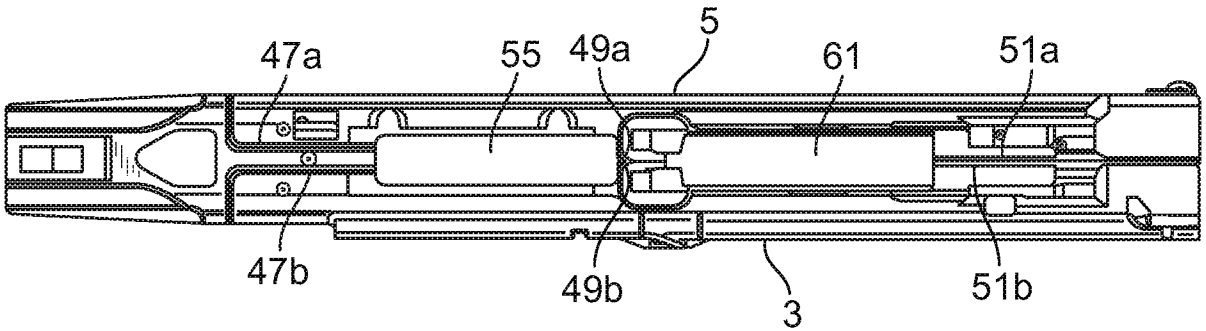
FIG. 10 depicts a bottom view of the example assembled weapon housing of FIG. 9.
Figure 11:
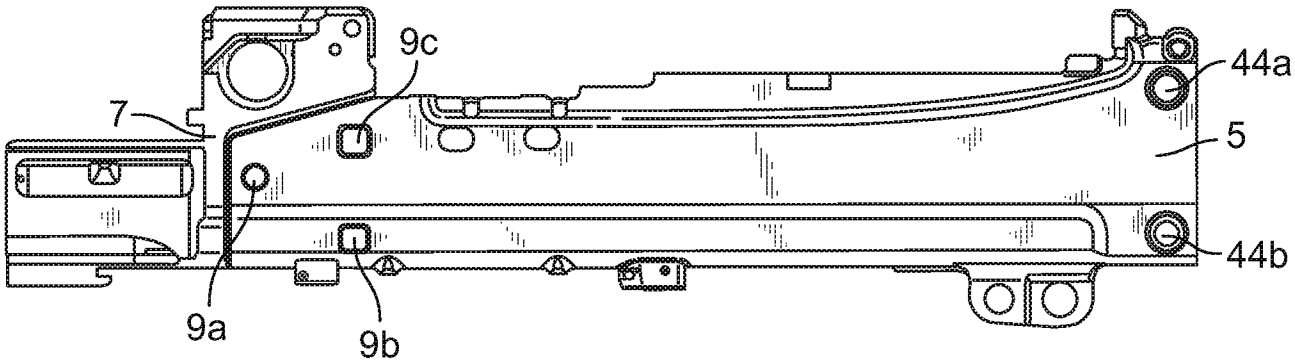
FIG. 11 depicts a lateral view of the left exterior view of the example assembled weapon housing of FIG. 9.
Figure 12:
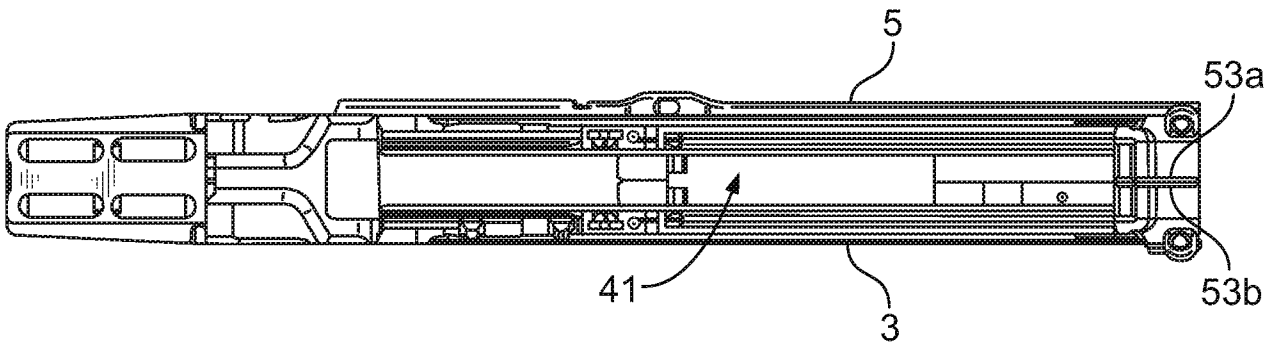
FIG. 12 depicts a top view of the example assembled weapon housing of FIG. 9.

FIGS. 10 and 12 show different connecting edges of the housing shells 3, 5 that enable the housing shells 3, 5 to be coupled and/or aligned relative to the connection block 7, to one another, etc., and then, for example, welded. The connecting edges may be beveled to enable a weld seam, weld notch and/or weld seam notch to form adjacent thereto. In this example, the connecting edges of the housing shells 3, 5 that enable the housing shells 3, 5 to be coupled and/or aligned relative to one another, preferably run on a vertical plane (e.g., symmetrical plane) that contains the axis of the bore 57 to enable work piece distortion to be minimized if the housing shells 3, 5 are welded. To assemble and/or couple the housing shells 3, 5 and the connection block 7, the housing shells 3, 5 and the connection block 7 are assembled, fixed at one or more points with tack welds and then welded to one another along the connecting edges.

When assembling and/or coupling the housing shells 3, 5 and the connection block 7, in some examples, welds may be placed at and/or adjacent to lower connecting edges 47*a*, 47*b*, central lower connecting edges 49*a* and 49*b*, rear lower connecting edges 51*a* and 51*b*, rear upper connecting edges 53*a* and 53*b* and/or at any other suitable location and/or edge.

A guide channel or recess 41 is formed between the housing shells 3, 5 in a hollow space. A breech assembly (not shown) may be housed and/or guided within the guide channel 41. In this example, a stabilization element 25 is positioned at the top of the guide channel 41. The stabilization element 25 may be a connecting yoke having an underside that includes retaining lugs on each side that act as centering elements (See FIG. 2). The stabilization element 25 stabilizes the assembled housing shells 3, 5 relative to one another. In particular, the stabilization element 25 stabilizes upper free edges of the housing shells 3, 5 in the longitudinal direction. In this example, the stabilization element 25 is inserted into position, as shown in FIG. 2, from above (e.g., similar to a bridge) and into recesses arranged there and/or adjacent thereto.

The recesses into which the retaining lugs of the stabilization element 25 are inserted may be formed in the shape of a half moon. The retaining lugs of the stabilization element 25 may center the stabilization element 25 in the longitudinal direction, the transverse direction and/or the vertical direction. In some examples, the stabilization element 25 is additionally secured relative to the housing shells 3, 5 via securing elements, screws, fasteners, etc., 27*a* and 27*b* that are inserted and/or threaded into recesses 28*a* and 28*b*, respectively.

A nose-shaped ejection element, portion and/or lug 29 may be positioned approximately in the center of the stabilization element 25 and may project into the guide channel 41. The ejection element 29 may protrude into a recess and/or groove (not shown) of a breech assembly (not shown) positioned, for example, within the guide channel 41. After the weapon is fired, the breech assembly moves from the connection block 8 toward the rear of the weapon in the direction of a stock (not shown). During the recoil process and/or as the breech assembly moves toward the rear of the weapon, a cartridge case (not shown) is removed from a cartridge camber (not shown) via an ejector (not shown) and moved toward the rear of the weapon where the ejection element 29 ejects the cartridge case downward and through a cartridge ejection or ejector port 55. In this example, the cartridge ejection port 55 (See FIG. 10) is constructed between the housing shells 3, 5. A breech end (not shown) may seal a rear end of the weapon housing 1.

In this example, the first and/or right housing shell 3 defines a guide slot 37 that enables movement of a charging or cocking handle 35. The guide slot 47 may be defined during the production of the housing shells 3 and/or 5. Additionally or alternatively, the guide slot 47 may be subsequently milled using, for example, a profiling cutter. Guide rails 39*a* and 39*b* (See FIG. 2) of the second or left housing shell 5 may additionally guide the movement of the charging handle 35.

In this example, a carrier pin or portion 38 (FIG. 1) extends through a guide slot 37 (FIG. 2) and into the guide channel 41 in which the breech block is guided. Extending the carrier pin 38 into the guide channel 41 enables rearward movement of the charging handle 35 to correspondingly move the breech block toward the rear of the weapon. The carrier pin 38 is connected to the charging handle 35. The charging handle 35 may be secured and/or locked in any suitable position to substantially prevent the charging handle 35 from being moved back and forth by the breech assembly when the weapon is fired.

In this example, lugs 43*a* and 43*b* are mounted toward the rear of the housing shells 3, 5. Additionally, recesses, apertures 44*a* and 44*b* are mounted and/or defined toward the rear of the housing shells 3, 5 to enable a shoulder support, etc. (not shown) to be fastened and/or secured thereto.

Figure 5:
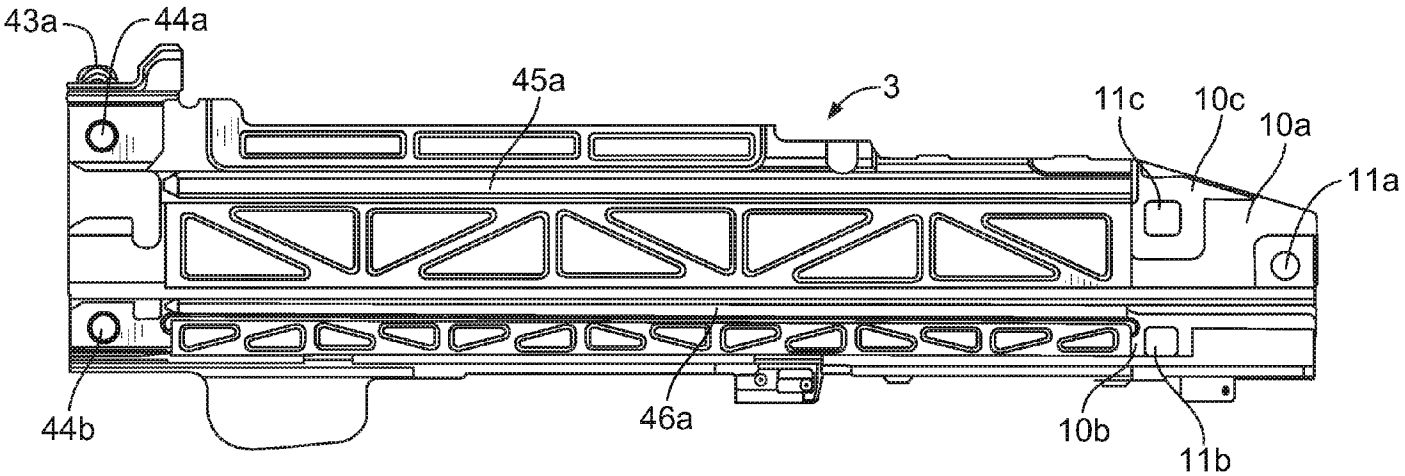
FIG. 5 depicts a lateral view of the interior of the example first housing shell of FIG. 3.
Figure 6:
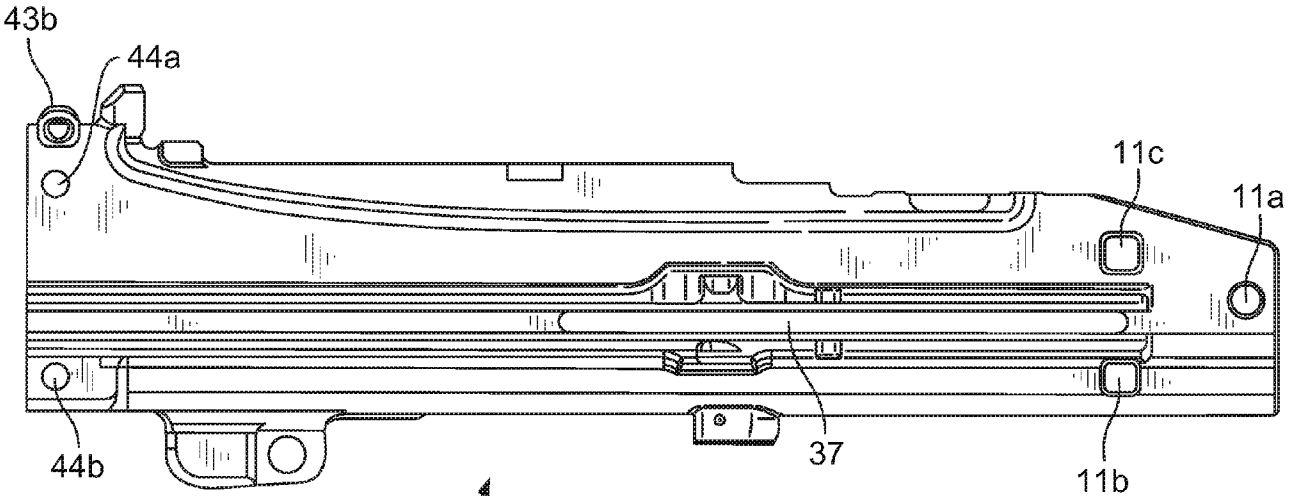
FIG. 6 depicts a lateral view of the right exterior of an example second housing shell in accordance with the teachings of this disclosure.
Figure 7:
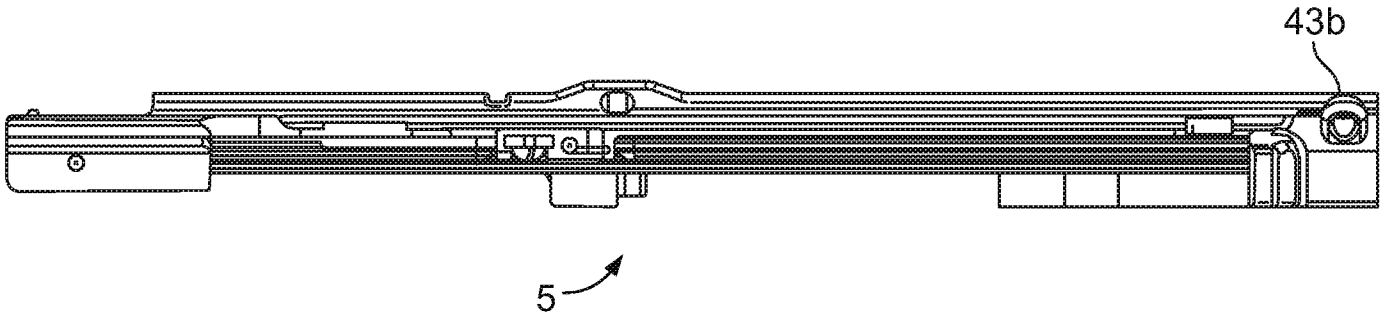
FIG. 7 depicts a top view of the example second housing shell of FIG. 6.
Figure 8:
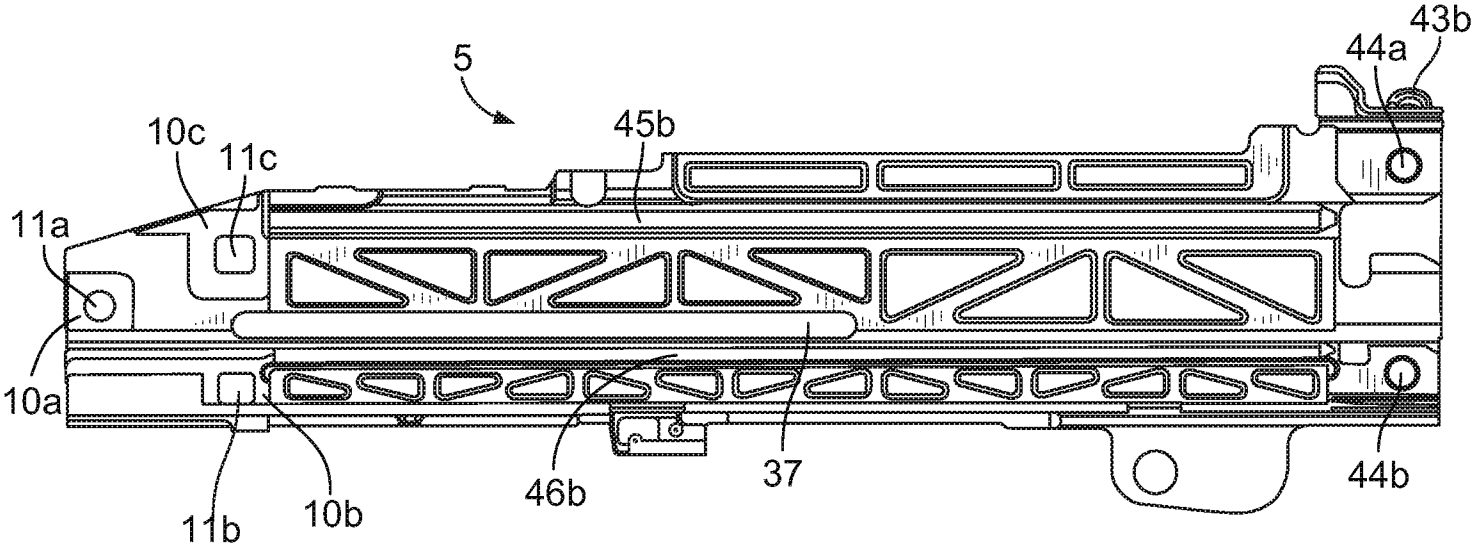
FIG. 8 depicts a lateral view of the interior of the example second housing shell of FIG. 6.
Figure 9:
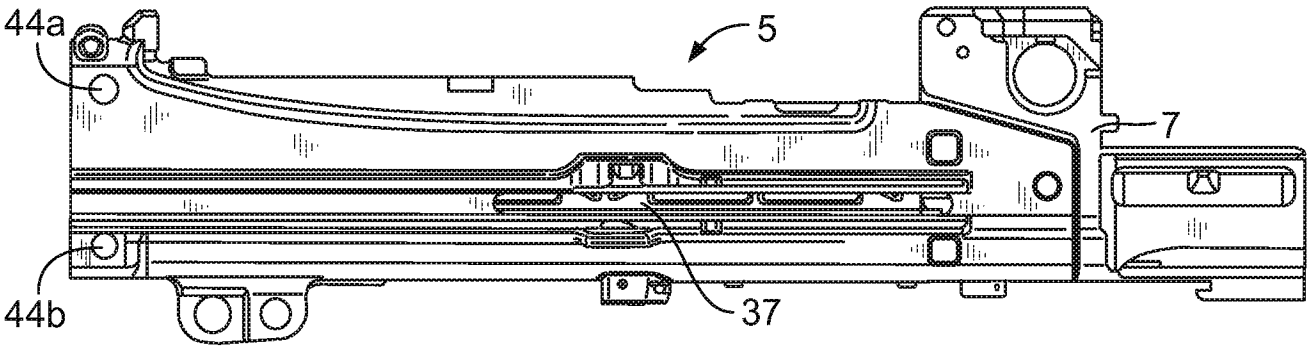
FIG. 9 depicts a lateral view of the right exterior of an example weapon housing in which the example housing shells of FIGS. 3 and 6 are assembled.

FIGS. 5 and 8 depict respective interiors of the housing shells 3, 5. The housing shells 3, 5 include upper guide tracks or rails 45*a*, 45*b* and lower guide tracks or rails 46*a* and 46*b* that are configured to engage and/or guide the movement of the breech assembly. In some examples, the breech assembly may include a roller guide (not shown) or other guiding means that guide the movement of the breech assembly along and/or relative to the guide tracks 45*a*, 45*b*, 46*a* and/or 46*b* as the breech assembly moves back and forth as the weapon is fired (e.g., a shot is fired) and/or as a round is chambered. The guide tracks 45*a*, 45*b*, 46*a* and/or 46*b* may be of any size, elevation and/or shape and may be a recess, groove, indentation, formation, guide rail, elevated guide, etc.

In some examples, to guide and/or support the breech block housing horizontally in the transverse direction and vertically in the longitudinal direction (e.g., along the axis of the bore 57), the upper and lower guide tracks 45*a*, 45*b*, 46*a* and/or 46*b* engage in guiding grooves (not shown) on the left and right side of a breech block support and/or housing (not shown).

FIG. 10 depicts another recess, groove and/or cavity 61 on the underside of the assembled weapon housing 1 though which a trigger unit and/or assembly (not shown) may be inserted and/or introduced. The cartridge ejection port 55 may or may not be covered with a cover panel (not shown). The top of the weapon housing 1 may be sealed by a cartridge feed cover (not shown). While not shown, other elements such as a sighting device and/or scope may be mounted to the weapon housing 1.

Figure 13:
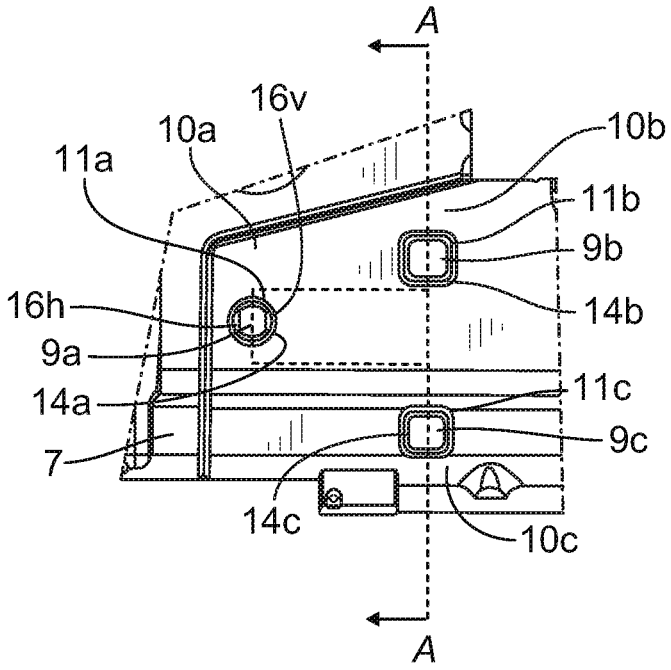
FIG. 13 depicts an enlarged detailed view of example positioning recesses and connecting pins of the example first housing shell.

FIG. 13 depicts an enlarged detailed representation of the positioning recesses 11*a*, 11*b* and 11*c*, the connecting pins 9*a*, 9*b* and 9*c* and the connecting joints 14*a*, 14*b* and 14*c*.

Figure 14:
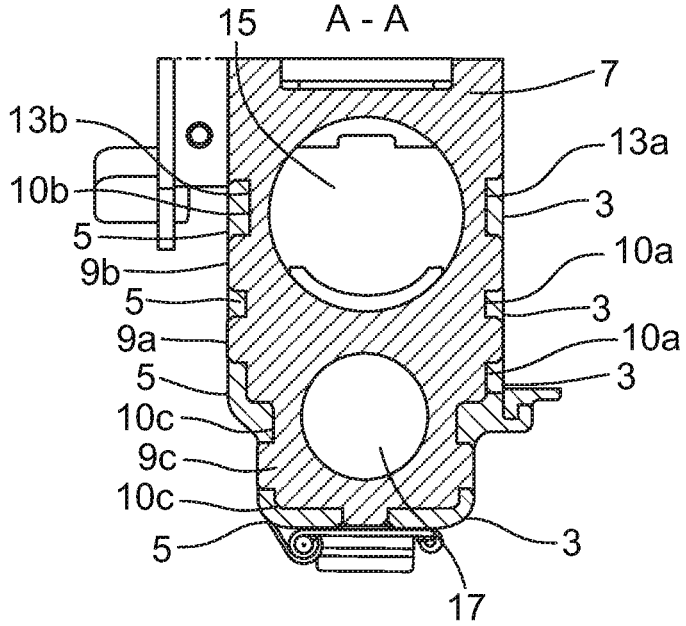
FIG. 14 depicts a sectional view of the example positioning recesses and connecting pins along A-A of FIG. 13.

FIG. 14 depicts a cross-sectional view of the connection block 7, the positioning recesses 11*a*, 11*b* and 11*c* and the connecting pins 9*a*, 9*b* and 9*c* along A-A of FIG. 13. The example of FIG. 14 clearly depicts how the housing shells 3, 5 are in contact with the lateral coupling flanks 13*a*, 13*b* of the connection block 7 in the assembled position.

The connection block 7 includes and/or defines a barrel receptacle (e.g., a cylindrical barrel receptacle) 15. A locking piece (not shown) having a cylindrical surface connected to a barrel may be inserted into the barrel receptacle 15. In this example, the barrel receptacle 15 has cylindrical clearance that enables axial alignment of the barrel assembly.

In some examples, the rotational position of the barrel (not shown) is defined, enabled and/or determined via two lateral guide cams 19*a*, 19*b*. The guide cams 19*a*, 19*b* can engage in corresponding recesses (not shown) defined in a stop collar of a locking piece of the barrel, for example. As such, alignment of a weapon scope and/or barrel can take place via the cylinder guide and/or the barrel receptacle 15, the guide cams 19*a*, 19*b*, recesses and/or the stop collar.

A flattened rotatable fixing shaft 21 may be positioned on an upper end or portion of the connection block 7. The shaft 21 may engage in a corresponding groove, aperture, etc. (not shown) that runs transversely in the locking piece to axially fix the barrel assembly relative to the weapon housing 1. In this example, the shaft 21 is actuatable via a control lever 23. The shaft 21 and/or the lever 23 may be locked and/or released via a handle (e.g., a pivoting position of a carrying handle). The handle may be locked and/or secured in a carrying position.

In this example, a gas rod holder or receptacle (e.g., a cylindrical gas rod holder) 17 is defined by the connection block 7 underneath the barrel receptacle 15. A gas rod or gas rod guide (not shown) may be inserted into or otherwise coupled to and/or within the gas rod holder 17 to enable a gas operated reloading mechanism to be actuated and/or operated in a known fashion.

A shaft receiving region such as, adjacent apertures 44*a*, 44*b*, may be defined and/or constructed toward the rear end of the housing shells 3, 5. In some examples, the shaft receiving region can be connected and/or coupled to a shoulder support (not shown) via a shoulder support holding fixture (not shown). The shoulder support holding fixture may include two dovetail claws or portions having variable width guiding grooves defined and/or extending in the axial direction. The guiding groove may receive and/or be engaged by corresponding guide rails constructed on the shoulder support. A borehole may be defined in the breech end (not shown) that may cooperate with a corresponding cylindrical piston section on the shoulder support to enable the shoulder support to be centered and axially aligned when inserted, for example.

When the shoulder support is inserted, the shoulder support may be rotated about a pivot axis such that the guide rails of the shoulder support engage in and/or are received by the corresponding guiding grooves of the shoulder support holding fixture. At the guiding grooves, the guide rails may be secured and/or spring catch locked in a particular rotational position via a locking lever (not shown). One end of the guiding grooves of the shoulder support holding fixture may be closed and/or tapered to enable the guide rails of the shoulder support to be introduced therein from only the open and/or opposing end. As such, the shoulder support may be inserted, secured and/or locked relative to the weapon housing 1 in a particular position (e.g., self-dropping design).

The examples disclosed herein relate to the weapon housing 1 that includes two housing shells 3, 5 and at least one connection block 7. The connection block 7 includes at least two connecting pins 9*a*, 9*b* and 9*c*. Each housing shell 3, 5 includes one or more positioning recesses 11*a*, 11*b* and 11*c*. On the assembly plane on the connection block 7, one or more of the positioning recesses 11*a*, 11*b* and/or 11*c* of the housing shells 3, 5 are placed and/or aligned with one or more of the connecting pins 9*a*, 9*b* and/or 9*c*. The examples disclosed herein also relate to weapons and/or firearms with weapon housings constructed in accordance with the teachings of this disclosure. The examples disclosed herein also relate to methods of manufacturing and/or assembling the weapon housing 1. The example methods include providing at least two housing shells 3, 5 and at least one connection block 7. The connection block 7 includes at least two connecting pins 9*a*, 9*b* and/or 9*c* and each of the housing shells 3, 5 includes at least one positioning recess 11*a*, 11*b* and 11*c*. The example method also includes placing and aligning the housing shells 3, 5 on an assembly plane on and/or of the connection block 7 using at least one of the positioning recesses 11*a*, 11*b* and/or 11*c* and the corresponding connecting pin 9*a*, 9*b* and/or 9*c* and then connecting the housing shells 3, 5 to the connection block 7.

As disclosed above, the weapon housing 1 includes at least two housing shells 3, 5 and at least one connection block 7. The connection block 7 includes at least two connecting pins 9*a*, 9*b* and/or 9*c* and each housing shell 3, 5 defines at least one positioning recess 11*a*, 11*b* and/or 11*c*. When the housing shells 3, 5 are placed and/or aligned on an assembly plane, the connecting pins 9*a*, 9*b* and/or 9*c* are received by the corresponding positioning recess 11*a*, 11*b* and/or 11*c* to enable forces acting in or against the direction of fire to be absorbed by surfaces of at least one of the connecting pins 9*a*, 9*b* and/or 9*c* and by at least one of the positioning recesses 11*a*, 11*b* and/or 11*c*.

As disclosed above, an example method of manufacturing the weapon housing 1 includes providing at least two housing shells 3, 5 and at least one connection block 7. The connection block 7 includes at least two connecting pins 9*a*, 9*b* and/or 9*c* and each of the housing shells 3, 5 includes at least one positioning recess 11*a*, 11*b* and/or 11*c*. Interaction between at least one positioning recess 11*a*, 11*b* and/or 11*c* and the corresponding connecting pin 9*a*, 9*b* and/or 9*c* places and/or aligns the housing shells 3, 5 on an assembly plane on the connection block 7.

The weapon housing 1 may include several housing shells and/or housing elements (e.g., 1, 2, 3, 4, etc.). However, preferably, the weapon housing 1 includes two split housing halves and/or shells 3, 5 that are positioned substantially perpendicular relative to one another. The connecting pins 9*a*, 9*b* and/or 9*c* and/or the positioning recesses 11*a*, 11*b* and/or 11*c* may have any geometry, rounded portions, angles, etc. The connecting pins 9*a*, 9*b* and/or 9*c* that correspond to the respective positioning recesses 11*a*, 11*b* and/or 11*c* may be similar or different from one another.

During assembly, the housing shells 3, 5 can be placed on the connection block 7 and the connecting pins 9*a*, 9*b* and/or 9*c* are then positively engaged with the corresponding positioning recess 11*a*, 11*b* and/or 11*c* and the insides of the housing shells 3, 5 are then placed on the coupling flanks 13*a*, 13*b* of the connection block 7. During the assembly process, the housing shells 3, 5 are aligned relative to one another and relative to the connection block 7 and held via a form closure on an assembly plane on the connection block 7. Thus, the connection block 7 forms a retaining and positioning base for the housing shells 3, 5. The interaction between the housing shells 3, 5 and the connection block 7 enables the housing shells 3, 5 to be relatively easily centered and/or aligned relative to one another and relative to an axis of the barrel or the axis of the bore 57 of the weapon.

The housing shells 3, 5 may be made of any suitable material(s). For example, the housing shells 3, 5 may be produced by injection molding methods, die casting methods using injection molding materials, precision casting materials, die casting materials, precision casting steel, light metals, light metal alloys, aluminum, magnesium, etc. Additionally or alternatively, polymer materials and/or reworked housing shells made of steel, sheet metal stamped parts, etc., may be used. Additionally or alternatively, combinations of various materials may be used to make the housing shells 3, 5. Because the service life of modern machine guns is relative high (e.g., more than 50,000 shots), loadable materials such as steel and/or steel alloys may be used to make the housing shells 3, 5.

One or more of the connecting pins 9*a*, 9*b* and/or 9*c* may be arranged on sides of the connection block 7 such as, for example, in front of the connection block 7, above the connection block 7 and/or below the connection block 7. However, preferably and in accordance with the teachings of this disclosure, the connecting pins 9*a*, 9*b* and/or 9*c* are arranged and/or constructed in and/or on the coupling flanks 13*a*, 13*b* of the connection block 7 to provide a plane of assembly and/or assembly plane.

One or more of the connecting pins 9*a*, 9*b* and/or 9*c* may be inserted into the connection block 7 and/or mounted thereon. However, preferably and in accordance with the teachings of this disclosure, the connecting pins 9*a*, 9*b* and/or 9*c* are constructed as a single piece on the connection block 7 by, for example, milling, etc. The coupling flanks 13*a*, 13*b* of the connection block 7 advantageously define the assembly plane for the housing shells 3, 5. The housing shells 3, 5 fit on the coupling flanks 13*a*, 13*b* when connecting and/or coupling the housing flanks or shells 3, 5 to the connection block 7.

As disclosed above, the connection block 7 may include three connecting pins 9*a*, 9*b* and/or 9*c* on the coupling flanks 13*a*, 13*b* and the housing shells 3, 5 may include and/or define three positioning recesses 11*a*, 11*b* and/or 11*c*. Providing the connection block 7 with three connecting pins 9*a*, 9*b* and/or 9*c* and providing each of the housing shells 3, 5 with three positioning recesses 11*a*, 11*b* and/or 11*c*, which are gravitationally centered, is advantageous in that the housing shells 3, 5 can be aligned and secured relative to the connection block 7 with a three-point support. The gravitational centering of the connecting pins 9*a*, 9*b* and/or 9*c* relative to the positioning recesses 11*a*, 11*b* and/or 11*c* substantially prevents torsional forces from acting on the connecting pins 9*a*, 9*b* and/or 9*c* (e.g., because the main forces run through the center of gravity of the triangle defined and/or spanned by the connecting pins 9*a*, 9*b* and 9*c*).

The one or more positioning recesses 11*a*, 11*b* and/or 11*c* may be depressions, indentations, etc., in the respective housing shell 3, 5. Additionally and/or alternatively, the one or more positioning recesses 11*a*, 11*b* and/or 11*c* can penetrate and/or be defined by the housing shells 3, 5. Having the positioning recesses 11*a*, 11*b* and/or 11*c* penetrate and/or define the housing shells 3, 5, enables placement and/or receipt of the connecting pins 9*a*, 9*b* and/or 9*c* within and/or relative to the respective positioning recesses 11*a*, 11*b* and/or 11*c* to be simplified. Additionally, the examples disclosed herein substantially prevent the housing shells 3, 5 from slipping relative to the connection block 7. The positioning recesses 11*a*, 11*b* and/or 11*c* may be produced and/or defined on the housing shells 3, 5 by notching the housing shells 3, 5 during production or subsequently producing a recess(es), milling groove, borehole, aperture, opening, etc., on the housing shells 3, 5.

As disclosed above, the connection block 7 and the housing shells 3, 5 may be further coupled together at one or more of the positioning recesses 11*a*, 11*b* and/or 11*c* and the corresponding connecting pins 9*a*, 9*b* and/or 9*c* with a weld or other fastening methods. By welding one or more of the positioning recesses 11*a*, 11*b* and/or 11*c* and the connecting pins 9*a*, 9*b* and/or 9*c*, the housing shells 3, 5 can be positively and/or non-positively coupled to the connection block 7 and/or the respective connecting pins 9*a*, 9*b* and/or 9*c*. Additionally or alternatively, the positioning recesses 11*a*, 11*b* and/or 11*c* and the corresponding connecting pins 9*a*, 9*b* and/or 9*c* may be coupled with glue, soldering or other fastening methods. Because of the interaction between, the sizing and/or dimensioning of the connecting pins 9*a*, 9*b* and/or 9*c* and the positioning recesses 11*a*, 11*b* and/or 11*c* and/or the thicknesses of the housing shells 3, 5, forces acting in or against the direction of fire will substantially not be absorbed by the weld seams. Instead, forces acting in the direction of fire will be substantially absorbed by surfaces of the connecting pins 9*a*, 9*b* and/or 9*c* and/or the positioning recesses 11*a*, 11*b* and/or 11*c*, thereby substantially preventing any weld seams from being overloaded, strained, damaged, etc.

As disclosed above, the example weapon housing 1 may include at least two connecting pins 9*a*, 9*b* and/or 9*c* and at least two positioning recesses 11*a*, 11*b* and/or 11*c*, which are arranged at cross-sectional planes relative to one another. As a result, alignment of the housing shells 3, 5 relative to the connection block 7 in the assembled position is substantially simplified because multiple, several and/or a plurality of assembly points (e.g., the connecting pins 9*a*, 9*b* and/or 9*c* and the positioning recesses 11*a*, 11*b* and/or 11*c*) are defined and/or provided.

As disclosed above, the example weapon housing 1 includes the connection block 7 that may include one or more of the positioning recesses 11*a*, 11*b* and/or 11*c* and/or the connecting pins 9*a*, 9*b* and/or 98*c* to enable longitudinal alignment, coupling and/or locking of the housing shells 3, 5 relative to the connection block 7. Preferably, in some examples, one or two of the rear positioning recesses 11*a*, 11*b* and/or 11*c* and one or two of the connecting pins 9*a*, 9*b* and/or 9*c* have a rectangular shape, which substantially enables high forces acting in the direction of fire to be absorbed. However, the positioning recesses 11*a*, 11*b* and/or 11*c* and the connecting pins 9*a*, 9*b* and/or 9*c* may be any suitable shape, size, design, etc.

As disclosed above, the angular design of the connecting pins 9*a*, 9*b* and/or 9*c* and the positioning recesses 11*a*, 11*b* and/or 11*c* provide a form closure on the longitudinal areas, transverse surfaces and/or lateral surfaces (e.g., all lateral surfaces) of the connecting pins 9*a*, 9*b* and/or 9*c* and the positioning recesses 11*a*, 11*b* and/or 11*c*. In some examples, if the form closure is provided only on the transverse surfaces or the longitudinal surfaces, to enable the connecting pins 9*a*, 9*b* and/or 9*c* to be easily insertable and/or received by the respective positioning recesses 11*a*, 11*b* and/or 11*c*, sufficient clearance may be provided and/or ensured on the respective transverse and/or longitudinal surfaces of the connecting pins 9*a*, 9*b* and/or 9*c* and/or the positioning recesses 11*a*, 11*b* and/or 11*c*. Advantageously, in some examples, the form closure on the transverse surfaces is formed perpendicular to the direction of fire to enable forces acting in the direction of the fire (e.g., the greatest forces) to be absorbed.

As disclosed above, at least one of the positioning recesses 11*a*, 11*b* and/or 11*c* and at least one of the connecting pins 9*a*, 9*b* and/or 9*c* enable height adjustment, coupling and/or locking of the housing shells 3, 5 to the connection block 7. As such, the examples disclosed herein include a rear connection, an upper connection and/or a lower connection between the connecting pins 9*a*, 9*b* and/or 9*c* and the positioning recesses 11*a*, 11*b* and/or 11*c*. In some examples, the front positioning recesses 11*a*, 11*b* and/or 11*c* and the front connecting pin 9*a*, 9*b* and/or 9*c* have a flattened shape and/or portion to enable and/or provide height adjustment for the housing shells 3, 5 relative to the connection block 7.

As disclosed above, the housing shells 3, 5 of the example weapon housing 1 can be coupled and/or connected together at and/or along connecting edges in the direction of fire. At least some of the connecting edges may be welded together. The housing shells 3, 5 may be coupled and/or connected together at their upper and/or lower edges facing one another. Preferably, in some examples, the housing shells 3, 5 are at least partially welded together using any suitable welding method such as laser welding. Preferably, in some examples, the housing shells 3, 5 are welded only at the upper and lower connecting edges toward the rear of the weapon housing 1. When assembling the housing shells 3, 5, welding between the housing shells 3, 5 may be minimized to substantially prevent distortion of the mold.

In some examples, the bearing weld joint of the welded, coupled and/or connected housing shells 3, 5 runs in the direction of fire and/or in the direction of force being subjected to the weapon housing 1 to substantially reduce overstraining, distortion, etc., of the weapon housing 1. Using the examples disclosed herein, an amount of heat introduced and/or subjected to the weapon housing 1 by welding methods and any distortion caused thereby may be minimized and/or completely prevented. Using the examples disclosed herein, high dimensional stability may be ensured by elements of the weapon housing 1 that are subjected to tensile loads. Using the examples disclosed herein, the half-stocks housing and/or half shells 3, 5 may be thin-walled.

In some examples, while extensive processing may take place on the outer contour and/or design of the housing shells 3, 5 prior to assembly, additional parts may not need to be welded to the housing shells 3, 5 thereafter, which reduces and/or prevents welding distortion and/or material weakening.

The examples disclosed herein substantially prevent subsequent shape corrections of the housing shells 3, 5 and/or the connection block 7 after production. The examples disclosed herein enable the housing shells 3, 5 to be assembled and/or produced with low production tolerances while ensuring a stable connection. The examples disclosed herein enable dimensional stability of the width and/or height to be maintained after the housing shells 3, 5 are coupled and/or connected. Maintaining this dimensional stability and, thus substantially zero clearance, is important because the cartridge feed cover, scope, accessory parts, etc., which require precise mounting, may be placed on top of the housing shells 3, 5. The examples disclosed herein enable the weapon housing 1 to be consistently, favorably, reliably, etc., produced.

As disclosed above, forces (e.g., tilting forces) may be transferred between one or more of the positioning recesses 11*a*, 11*b* and/or 11*c* and the connecting pins 9*a*, 9*b* and/or 9*c*. The tilting forces may be imparted by movement of the breech on and/or within the barrel receptacle 15 and/or the connection block 7. In some examples, the breech assembly may be guided by guide tracks 45*a*, 45*b*, 46*a* and/or 46*b* between the housing shells 3, 5. The guide tracks 45*a*, 45*b*, 46*a* and/or 46*b* may be produced during production, after production, subsequently incorporated during a machine finishing process, etc. The alignment of the housing shells 3, 5 on the connection block 7 also secures the alignment of the guide tracks 45*a*, 45*b*, 46*a* and/or 46*b* even if the guide tracks 45*a*, 45*b*, 46*a* and/or 46*b* are finished and/or produced prior to the housing shells 3, 5 being assembled.

As disclosed above, the stabilization element 25 may stabilize the weapon housing 1 and/or connect and/or couple the housing shells 3, 5 together. In this example, the stabilization element 25 is a bridge element that may be arranged at various positions between the assembled housing shells 3, 5. Preferably, in some examples, the stabilization element 25 is centrally positioned and/or arranged on the top of the housing shells 3, 5. The stabilization element 25 enables the stability of the weapon housing 1 to be increased and/or substantially prevents tilting and/or misalignment of the housing shells 3, 5 relative to one another.

The stabilization element 25 may be coupled to the housing shells 3, 5 by, for example, a weld, glue, fastener, etc. However, preferably, in some example, the stabilization element 25 is introduced and/or inserted into the recess defined, constructed and/or provided by upper sides of the housing shells 3, 5. The recess may be constructed in a form-fitting manner via T-slots.

As disclosed above, the stabilization element 25 may be secured and/or coupled to either or both of the housing shells 3, 5 by the securing elements or fasteners 27*a*, 27*b* and/or by a centering device and/or element. The fasteners 27*a*, 27*b* may be screws that vertically penetrate and/or extend through the stabilization element 25 to the housing shells 3, 5 to connect and/or couple the stabilization element 25 thereto. The stabilization element 25 may be secured and/or coupled to the housing shells 3, 5, by any suitable fastener, methods, etc.

As disclosed above, the stabilization element 25 may include the ejection element 29. The ejection element 29 may be designed, configured, sized, positioned, etc., to engage a breech assembly, a breech block support and/or a breech head. In some examples, the ejection element 29 is a lug that protrudes into the weapon housing 1.

As disclosed above, the ejection element 29 can protrude into the breech assembly to eject a cartridge case during recoil. The ejection element 29 may protrude into a slotted axial recess constructed on the top the breech assembly on, for example, the breech block support, breech head, etc. During recoil of the breech assembly, an extracted cartridge case can be ejected from the breech head downward through the cartridge ejection port 55 and from the weapon housing 1 using the ejection element 29.

As disclosed above, the connection block 7 of the weapon housing 1 may include at least one barrel receptacle 15. In this example, the barrel receptacle 15 is sized and/or adapted to the dimensions of the barrel and/or a locking piece. Using the examples disclosed herein, advantageously, a barrel and/or a weapons scope can be relatively easily aligned relative to the connection block 7. Additionally or alternatively, using the examples disclosed herein, the housing shells 3, 5 can be aligned with the connection block 7 and/or relative to the axis of the bore 57 of the weapon.

As disclosed above, the connection block 7 of the weapon housing 1 can be connected to a gas extractor and/or a gas operated reloading mechanism on the barrel and a gas guide rod via the gas rod holder 17. The gas operated reloading mechanism can operate in a known manner to cycle the weapon. The examples disclosed herein provide a compact, space saving elements, etc.

As disclosed above, the examples described herein relate to firearms and/or weapons having the weapon housing 1. The weapon housing 1 may be produced with high precision and/or dimensional accuracy, low production tolerances, cost effectively, etc. The examples described herein may be produced and/or assembled relatively quickly and, thus, high profitability can be attained while enabling any design, housing shell 3, 5 modification, etc. to be achieved. In some examples, the connection block is coupled to one or more of the housing shells adjacent to the respective positioning recesses via a weld. In some examples, edges of the housing shells in the direction of fire are coupled together via a weld.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A weapon housing for use with a firearm, comprising: at least two housing shells, each of the housing shells comprises positioning recesses; and a connection block comprising first protrusions and second protrusions, the protrusions are integral to and extend from the connection block, the first protrusions being a different size than the second protrusions, wherein, on an assembly plane of the connection block, the housing shells are to be positioned and aligned on the protrusions via the corresponding positioning recess to enable forces that are to act in or against a direction of fire to be absorbed by surfaces of at least one of the positioning recesses or at least one of the protrusions, wherein the connection block comprises a barrel receptacle, wherein the connection block comprises a gas rod holder to enable a gas operated reloading mechanism to be coupled thereto.

2. The weapon housing of claim 1, wherein the protrusions are positioned on coupling of the connection block, the coupling flanks defining the assembly plane.

3. The weapon housing of claim 1, wherein the connection block comprises a first coupling flank and a second coupling flank, each of the coupling flanks comprising the first protrusion, the second protrusion and a third protrusion and each of the housing shells comprising three positioning recesses.

4. The weapon housing of claim 1, wherein the positioning recesses of one or more of the housing shells is defined by the corresponding housing shell.

5. The weapon housing of claim 1, wherein the connection block is coupled to one or more of the housing shells adjacent to the respective positioning recesses.

6. The weapon housing of claim 5, wherein the connection block is coupled to one or more of the housing shells via a weld.

7. The weapon housing of claim 1, wherein the protrusions and positioning recesses of the housing shells are arranged at a cross-sectional plane relative to one another.

8. The weapon housing of claim 1, wherein a connection between at least one of the protrusions and the corresponding positioning recess enables longitudinal alignment of the housing shells relative to the connection block.

9. The weapon housing of claim 1, wherein edges of the housing shells in the direction of fire are coupled together.

10. The weapon housing of claim 9, wherein the edges of the housing shells are coupled together via a weld.

11. The weapon housing of claim 1, wherein forces created by movement of a breech assembly relative to the connection block are to be transferred between the respective positioning recesses and the corresponding protrusion.

12. The weapon housing of claim 1, wherein the housing shells comprise guide tracks to enable a breech assembly to be guided relative to the housing shells.

13. The weapon housing of claim 1, further comprising a stabilization element to couple the housing shells together.

14. The weapon housing of claim 13, wherein the stabilization element is to be secured relative to at least one of the housing shells via a fastener and the stabilization element is to be aligned relative to the housing shells via a centering element.

15. The weapon housing of claim 13, wherein the stabilization element comprises an ejection element.

16. The weapon housing of claim 15, wherein the ejection element is to protrude into a breech assembly to enable a cartridge case to be ejected during recoil.

17. The firearm of claim 13, wherein the stabilization element comprises retaining lugs to center the stabilization element between the housing shells.

18. The firearm of claim 17, wherein the retaining lugs are to be received in recesses of the respective housing shells.

19. The firearm of claim 17, wherein the recesses comprise a half-moon shape.

20. The weapon housing of claim 1, wherein the housing shells are coupled together via a weld.

21. The firearm of claim 1, wherein the protrusions comprise a rectangular cross-section having beveled edges and rounded corners.

22. A firearm, comprising: a weapon housing, comprising: at least two housing shells, each of the housing shells comprises at least one positioning recess; and at least one connection block comprising first protrusions and second protrusions, the protrusions are integral to and extend from the connection block, the first protrusions being a different size than the second protrusions, wherein, on an assembly plane of the connection block, the housing shells are to be positioned and aligned on the protrusions via the corresponding positioning recess to enable forces that are to act in or against a direction of fire to be absorbed by surfaces of at least one of the positioning recesses or at least one of the protrusions; and a stabilization element to couple the housing shells together, the stabilization element comprising an ejection element and retaining lugs, the ejection element to protrude into a breech assembly to enable a cartridge case to be ejected during recoil, the retaining lugs to center the stabilization element between the housing shells, wherein the connection block comprises a barrel receptacle.

23. The firearm of claim 22, wherein the retaining lugs are to be received in recesses of the respective housing shells.

24. The firearm of claim 22, wherein the stabilization element comprises a yoke.

25. The firearm of claim 22, further comprising fasteners to couple the stabilization element and the housing shells.

26. A method of producing a weapon housing for use with a firearm, comprising: placing and aligning housing shells on an assembly plane of a connection block via an interaction between a recess of each of the housing shells and first protrusions and second protrusions of the connection block; the protrusions are integral to and extend from the connection block, the first protrusions being a different size than the second protrusions; positioning retaining lugs of a stabilization element between the housing shells to center the stabilization element between the housing shells; and coupling the housing shells together, wherein the connection block comprises a barrel receptacle, wherein the connection block comprises a gas rod holder to enable a gas operated reloading mechanism to be coupled thereto.

27. The method of claim 26, wherein coupling the housing shells together comprises welding the housing shells together.

28. The method of claim 26, wherein positioning the retaining lugs of the stabilization element between the housing shells comprises positioning the retaining lugs in recesses of the housing shells.

* * * * *